US010988215B1

(12) United States Patent
Martinez Sebastian

(10) Patent No.: US 10,988,215 B1
(45) Date of Patent: Apr. 27, 2021

(54) SURFBOARD AND METHOD OF CONSTRUCTION

(71) Applicant: Daniel Martinez Sebastian, London (GB)

(72) Inventor: Daniel Martinez Sebastian, London (GB)

(73) Assignee: Daniel Martinez Sebastian, London (GB)

( * ) Notice: Subject to any disclaimer, the term of this patent is extended or adjusted under 35 U.S.C. 154(b) by 0 days.

(21) Appl. No.: 17/067,180

(22) Filed: Oct. 9, 2020

(51) Int. Cl.
*B63B 32/50* (2020.01)
*B63B 32/59* (2020.01)
*B63B 32/57* (2020.01)

(52) U.S. Cl.
CPC ..... *B63B 32/50* (2020.02); *B63B 32/57* (2020.02); *B63B 32/59* (2020.02)

(58) Field of Classification Search
CPC ..... B63B 32/50; B63B 32/57; B63B 32/59
See application file for complete search history.

(56) References Cited

U.S. PATENT DOCUMENTS 1,608,000 A 6/1926 Ranlett
1,830,015 A * 11/1931 Carmichael ..... B63B 32/53 441/74
1,872,230 A * 8/1932 Blake ..... B63B 32/50 441/74
4,209,867 A * 7/1980 Abrams, III ..... B63B 32/50 441/74
4,302,859 A * 12/1981 Kozminski ..... B63B 32/50 441/74
10,577,059 B2 3/2020 Jackson
2004/0043680 A1* 3/2004 Mead ..... B29C 33/308 441/74
2005/0184432 A1* 8/2005 Mead ..... B29C 70/885 264/272.15
2009/0142975 A1* 6/2009 Zane ..... B63B 32/50 441/74

* cited by examiner

*Primary Examiner* — S. Joseph Morano
*Assistant Examiner* — Jovon E Hayes

(57) ABSTRACT

An improved wooden surfboard and method of construction comprised of pre-cut layers of wood longitudinally arranged of predetermined thicknesses (502-512) stacked and bonded together following the shape of the surfboard. The longitudinal layers include slots (208) to slide and embed multiple transverse ribs (210) in perpendicular direction for joining the longitudinal layers together. The bonded longitudinal layers form a pre-shaped plank with the geometrical features of the surfboard without the need of carving and shaping the surfboard's geometry. A smooth finish is achieved after a light sanding of the pre-shaped plank. In some embodiments the longitudinal layers have predetermined perforations (202) to create air chambers (204) reducing the weight of the surfboard. Other embodiments are as described and shown.

2 Claims, 14 Drawing Sheets

SURFBOARD AND METHOD OF CONSTRUCTION

This patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Prior Art

The following is a tabulation of some prior art that presently appears relevant:

U.S. Pats.

| Pat. No. | Issue Date | Patentee |
|---|---|---|
| 1,608,000 | Nov. 1926 | Ranlett |
| 1,872,230 | Aug. 1932 | Blake |
| 1,830,015 | Nov. 1931 | Carmichael |
| 4,209,867 | Jul. 1980 | Abrams, III |
| 4,302,859 | Dec. 1981 | Kozminski |
| 10,577,059 | Mar. 2020 | Kyle Jackson |

U.S. Patent Application Publications

| Publication Number | Publication Date | Applicant |
|---|---|---|
| 20090142975 | Jun. 2009 | Wallace Wayne Zane |

The first ancient surfboard designs until the beginning of the twentieth century were solid wooden boards using wood types other than balsa wood such us wiliwili, ulu, koa, redwood or cedar wood. They were originally shaped out of a single piece of wood, and later shaped from several timber sticks bonded together. These boards were long and heavy, they presented a lack of buoyancy and limited flexibility compared to modern surfboards. This is mainly due to the construction method developed at that time and the types of wood that were selected.

The introduction of balsa wood for the fabrication of water boards (U.S. Pat. No. 1,608,000 to Ranlett) helped reducing the weight substantially, thus improving the performance of the boards. The fabrication of solid boards made of balsa wood started in the early twentieth century. It became the one of the most extended materials at that time and continues being used at present as a minority in the surfboard industry. Solid balsa boards are typically made by gluing up a balsa plank joining several sticks of balsa wood (stick profile circa 20×30 cm). Other types of wood are intercalated in between the balsa sticks to add strength and resistance to impacts. The surfboard outline is traced in the balsa plank and cut perpendicular to the surface, being ready for carving the final shape manually with a drawknife and/or hand plane. The shaping of solid balsa boards is very time consuming and requires expertise in the art of shaping to be successfully accomplished. This technique also wastes a lot of material and it is unsuitable for mass production. Although this construction method was an improvement to the prior art at that time, it was soon overtaken by the invention of hollow boards and foam boards.

The construction of hollow boards started circa 1932 in parallel to the development of solid balsa boards—U.S. Pat. No. 1,830,015 to Carmichael, U.S. Pat. No. 1,872,230 to Blake. The main advantage of hollow boards versus solid boards is the weight reduction but hollow construction presents additional complexity. Several methods for constructing chambered boards were developed along the twentieth century (U.S. Pat. No. 4,209,867 to Abrams and U.S. Pat. No. 4,302,859 to Kozminski) and all of them present certain similarities. The main components of hollow boards during the twentieth century generally include top and bottom timber decks, side rails composed by one or multiple timber strips and an internal timber structure between the decks.

Modern construction in prior art of hollow wooden surfboards typically starts with the assembly of a longitudinal central spine and transversal ribs that form the structure and define the parameters of the board (length, width, rocker, and thickness). Afterwards, the bottom deck, rails, and top deck are subsequently bonded around the structure forming a shell, hence providing an sealed hollow body.

Both bottom and top deck are made of a single sheet of wood or by the assembly of multiple sheets of wood on the longitudinal direction. A bespoke frame to hold tight the structure to the deck is often used for each different surfboard geometry, in order to apply pressure to the bottom and top decks until the adhesive is set. This method of construction or variations of it combined with other techniques is still in use for hollow wooden boards.

The hollow construction described above is the most common method for building wooden boards at present, but it cannot compete with modern foam boards because of the ease of fabrication, lower construction cost and their overall water performance. The performance of a board is driven by its weight, flexion and geometry. The geometry of a board is specifically parametrized by the length, width, thickness, rocker, tail, nose and outline rails. All prior art known of construction of hollow wooden boards heavily relies on the shaper's skills to obtain these parameters as planned. The manual assembly of the structure, decks and rails in prior art leads to inaccuracies and deviations from the geometry to obtain. A substantial amount of time shaping and sanding is required before achieving the final shape ready for the application of a waterproof coating. Small deviations in any parameters of a board's geometry cited above will result in an undesired response of the board in the water. Wooden surfboards presently known in prior art are around twice the weight of an average modern foam board and hence less attractive to the market because they cannot compete with foam boards' water performance. Additional wooden surfboard drawbacks are the construction complexity and fabrication time, doubling and tripling the average foam board market price.

The outline rails are a very characteristic part of a surfboard in terms of geometry because they are inside the water when turning and they are directly related to the board's turning ability. Relevant prior art builds this part of the surfboard by bending and gluing one or several wooden strips of circa 1 cm thick, one on top of each other around the edge of the board's bottom deck. Alternatively, other prior art accomplishes the rails with wood lamination technique using thinner layers of wood. It is common to use steam bending technique for the tighter curves of the outline. These manual techniques allow to adapt wood profiles to a board's outline but lead to inaccuracies, provide low strength and have a risk of breakage during construction or internal breakage once bonded. Following the selected process of building the outline rails, they need to be carved and sanded manually from a primitive rectilinear profile to their final multi curved shape. The high degree of accuracy required makes it very difficult to succeed, leading to deviations from the ideal geometry to be achieved.

Over the last half of the twentieth century and twenty-first century, production of foam boards has surpassed the production of hollow and solid wooden boards and dominates the market at present. Foam boards are generally composed by a central plywood stringer and polyester or polyurethane foam at both sides. They are covered with a fiberglass cloth and a coating of epoxy or polyester resin to provide the strength required. The inherent disadvantage of the current epoxy or polyester resin laminated foam boards is the overall environmental impact: the use non-recyclable materials made from non-renewable sources, the toxicity of the particles during the sanding process of the resin and the greenhouse gas emissions and waste produced during the building process. Foam boards are not durable, so an average surf rider will need many surfboards over the years because they lose performance or breaks. The limited lifespan of foam boards, the use of non-recyclable and toxic materials and the large carbon footprint of this product make this construction method unsustainable in the modern era.

Other prior art is known in the form of construction kits for a layperson to make a hollow wooden surfboard. The construction method is identical to the hollow wooden boards described above but the wooden parts are unassembled for the end user to construct it. As it is the same technique, it also shares the same disadvantages. It is common to find in these kits a pre-cut stringer and ribs for assembly, timber sheets for building the bottom and top decks and thin wooden strips for building the outline rails. "Do It Yourself" (DIY) wooden kits known are very complex for a layperson to build them because it requires complex woodworking techniques with professional tools and advanced shaping and sanding processes resulting in a limited-quality final product.

SUMMARY

In accordance with one embodiment, a surfboard comprising pre-cut layers of wood along the length of the surfboard and perpendicular to its faces and several transverse ribs joining the longitudinal layers perpendicularly. The longitudinal sections are stacked and bonded together, obtaining the shape of the surfboard after a light sanding. The thicknesses of the longitudinal layers vary following the outline of the surfboard in order to match its geometry. In some embodiments, the longitudinal layers have predetermined perforations forming air chambers to reduce the overall weight of the surfboard. These longitudinal layers are made of balsa wood, and in various embodiments they are made of other type of wood or several types including composite wood. In other embodiments, the longitudinal layers can be split in shorter segments reducing the length of the pre-cut layers. Some embodiments further comprise the application of a coating for water protection on the bonded and sanded plank formed by the longitudinal layers.

DRAWINGS

Figures

In the drawings, closely related figures have the same number but different alphabetic suffixes.

Figure 1:
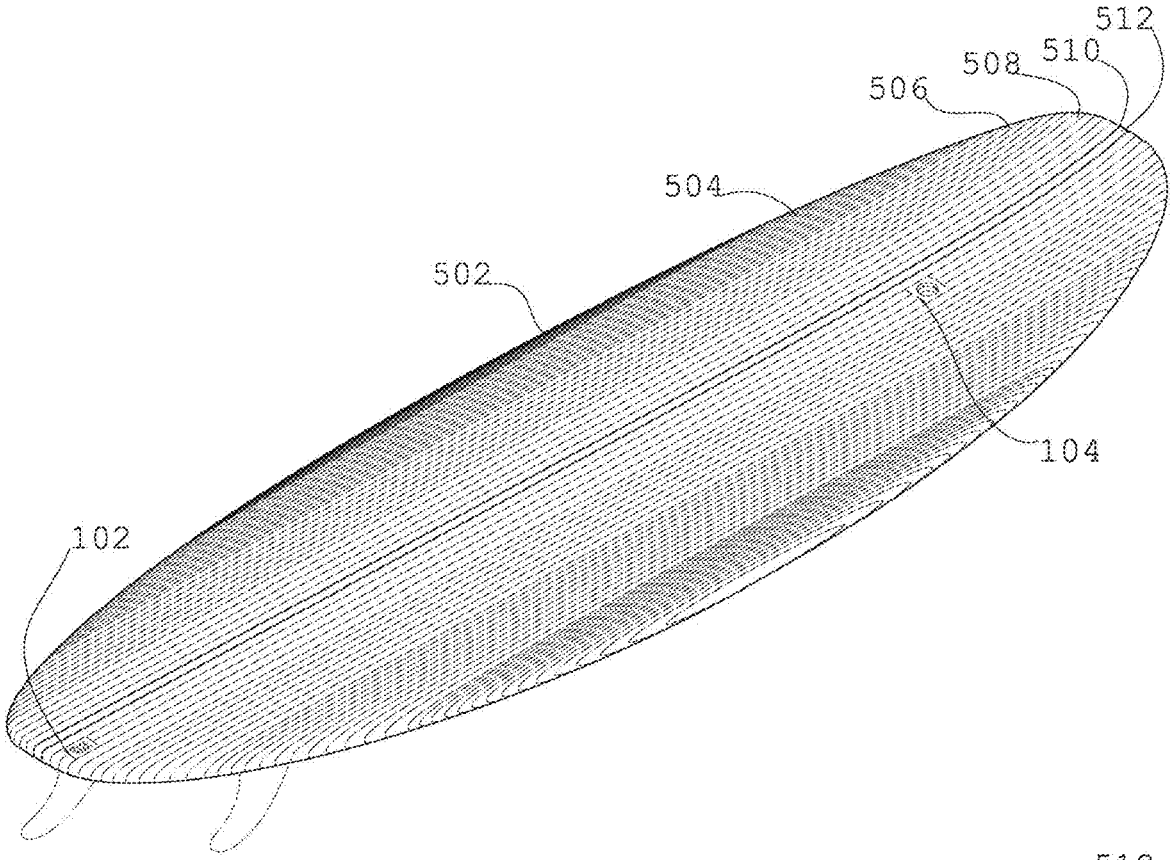
FIG. 1 shows a perspective view of the external appearance of one embodiment.

DRAWINGS REFERENCE NUMERALS (102) Rectangular recess in the longitudinal layers to allow for the installation of a leash plug.

(104) Rectangular recess in the longitudinal layers to allow for the installation of a vent plug for pressure equalization.

(132) Epoxy glue for bonding exemplary plugs and filling gaps.

(134) Exemplary fin plugs for fixing the fins to the surfboard.

(136) Exemplary surfboard fins.

(138) A sheet of wood with a cut-out for covering the fin plug.

(152) Exemplary leash plug.

(154) A sheet of wood with a cut-out for covering the leash plug.

(202) Predetermined perforations on the longitudinal layers of an embodiment creating air chambers.

(204) Air chambers of a hollow surfboard of an embodiment.

(206) Rectangular recesses in the longitudinal layers to allow for the installation of fin plugs.

(208) Predetermined slots in the longitudinal layers of an embodiment for joining transverse ribs.

(210) Pre-cut transverse ribs of an embodiment.

(212) Flat dowels to be assembled with slotting joints to the transverse ribs' ends.

(302) Slots in the longitudinal layers to ventilate the chambers.

(502) Pre-cut longitudinal layers of 3 mm thick in an exemplary embodiment.

(504) Pre-cut longitudinal layers of 6 mm thick in an exemplary embodiment.

(506) Pre-cut longitudinal layers of 9 mm thick in an exemplary embodiment.

(508) Pre-cut longitudinal layers of 12 mm thick in an exemplary embodiment.

(510) Pre-cut longitudinal layers of 1.5 mm thick in an exemplary embodiment.

(512) Central pre-cut longitudinal layer of 12 mm thick in an exemplary embodiment coincident with the axis of the surfboard.

(602) Butt joints between the segments forming the longitudinal layers of one embodiment.

(702) Clamps to apply pressure to the longitudinal layers while the adhesive is curing (support structure).

(704) Timber boards used between the clamps and longitudinal layers to apply pressure evenly (support structure).

(902) A sheet of wood with a cut-out for covering the vent plug.

(904) Exemplary vent plug that allows to ventilate the air chambers without water leakages.

(906) Timber spacers for installing the vent plug in position.

DETAIL DESCRIPTION

FIGS. 1-6—First and Second Embodiment

FIG. 1 shows a perspective view of the surfboard's appearance of one embodiment. The surfboard is comprised by pre-cut longitudinal layers (502-512) of predetermined thicknesses stacked, forming an exemplary board's shape to illustrate this embodiment. The layers are arranged perpendicular to both faces of the surfboard along its length and pre-cut following the geometry of the surfboard desired to make. Some of these layers have a rectangular recess (102) to allow for the installation of a leash plug at the tail of the board and another rectangular recess (104) to allow for the installation of a vent plug on the upper side of the board. In other embodiments, the locations of these recesses in the surfboard vary.

Figure 2:
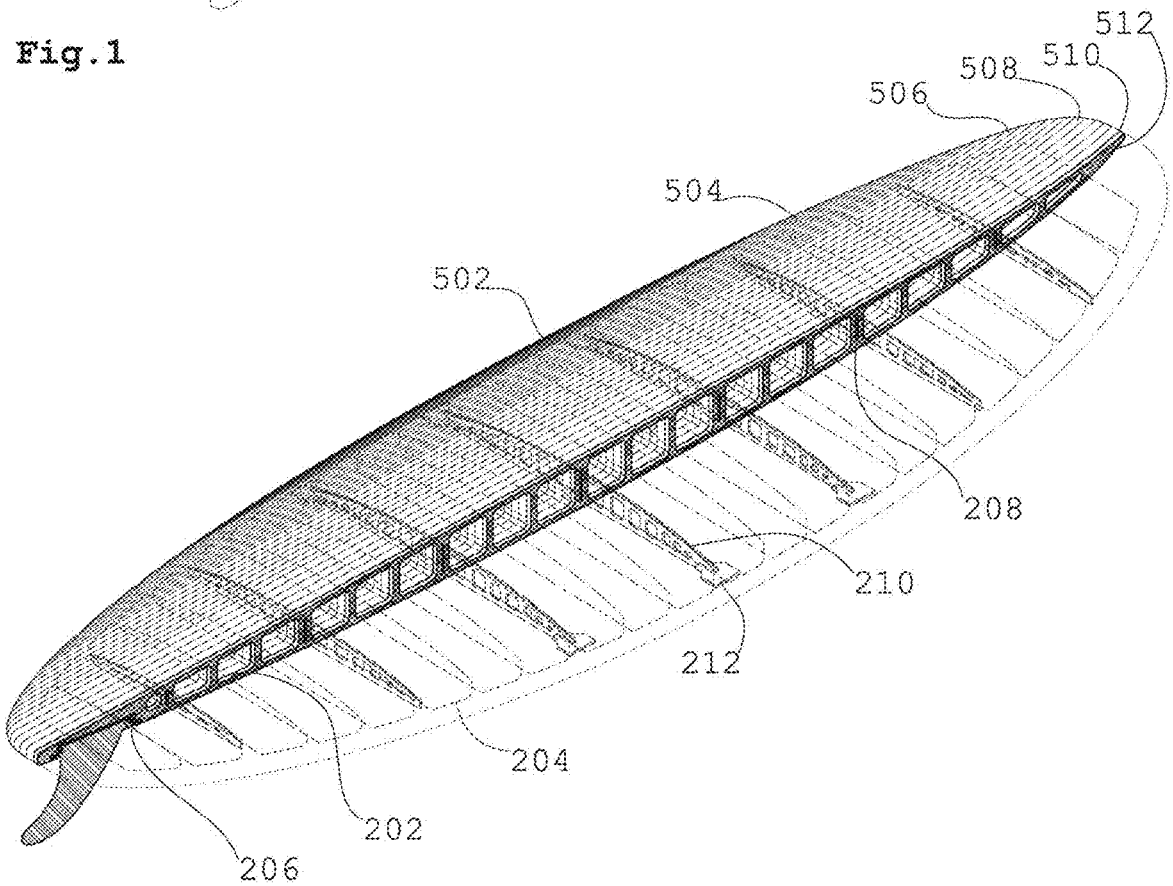
FIG. 2 shows a perspective view of one embodiment cut through the symmetry axis, showing the transverse ribs and the hollow construction.

As shown in FIG. 2, predetermined perforations (202) are provided along the longitudinal layers (502-512) comprising this embodiment to form air chambers (204) resulting in a hollow surfboard. The layers also have rectangular recesses (206) to allow for the installation of fin plugs on the underside of the board. The longitudinal layers of this embodiment include predetermined slots (208) for joining the layers with transverse ribs (210), sliding them perpendicular to the layers into these slots. The ribs (210) in cross direction provides structural unity to the surfboard by holding the longitudinal layers together and help stacking and bonding them in place during the assembly. Flat dowels (212) are assembled with slotting joints to the transverse ribs' ends connecting structurally the side rails of the surfboard to the transverse ribs (210).

Figure 3:
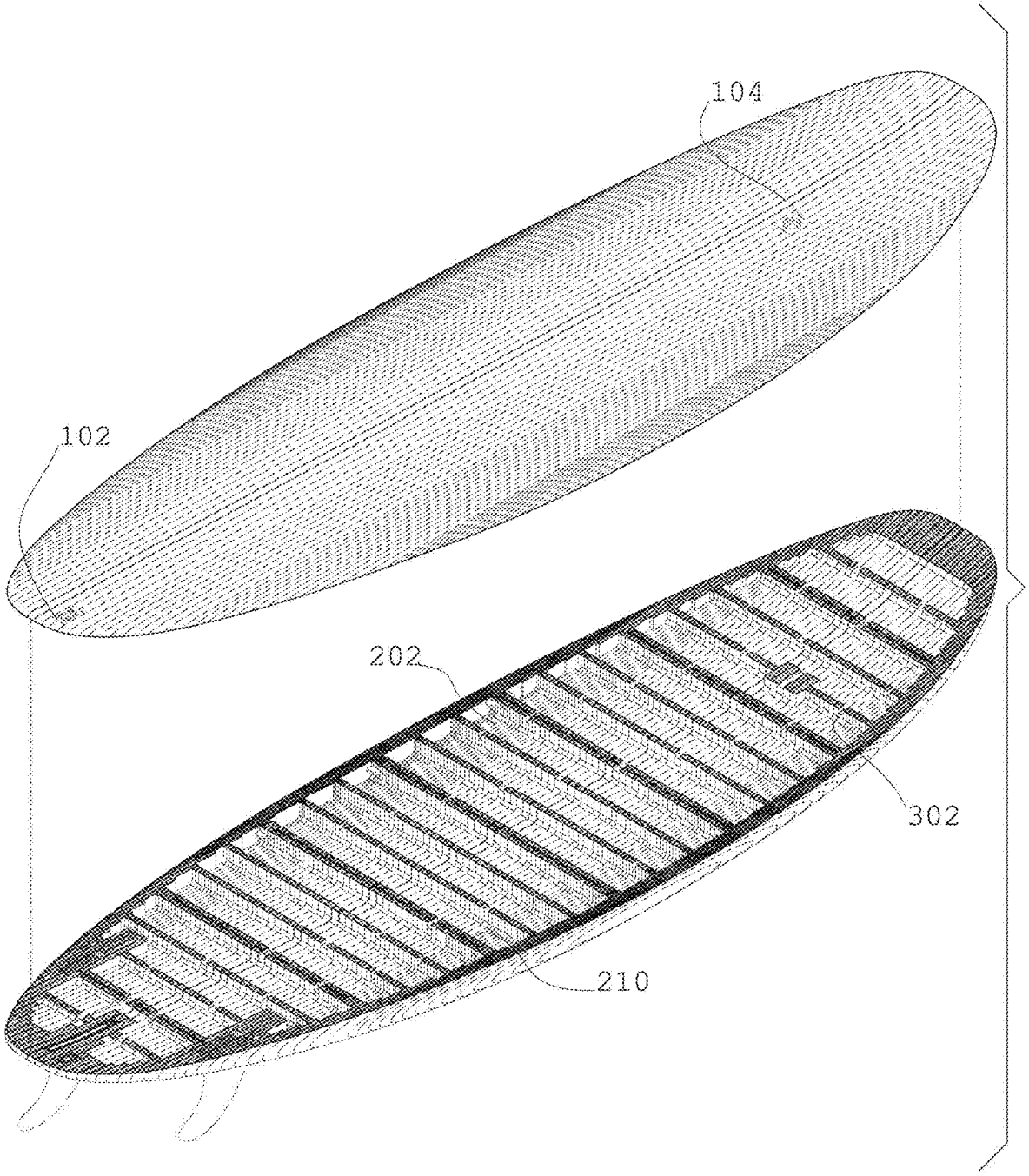
FIG. 3 shows an exploded perspective view of one embodiment showing the air chambers of the hollow construction and vent notches.
Figure 4:
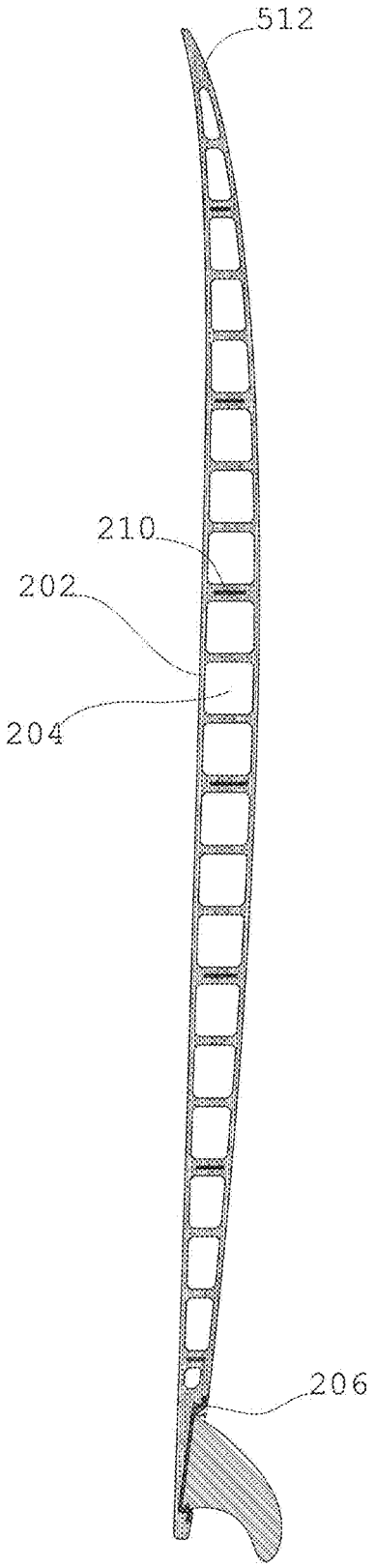
FIG. 4 shows a longitudinal section of an embodiment cut through the axis, showing its air chambers.
Figure 5:
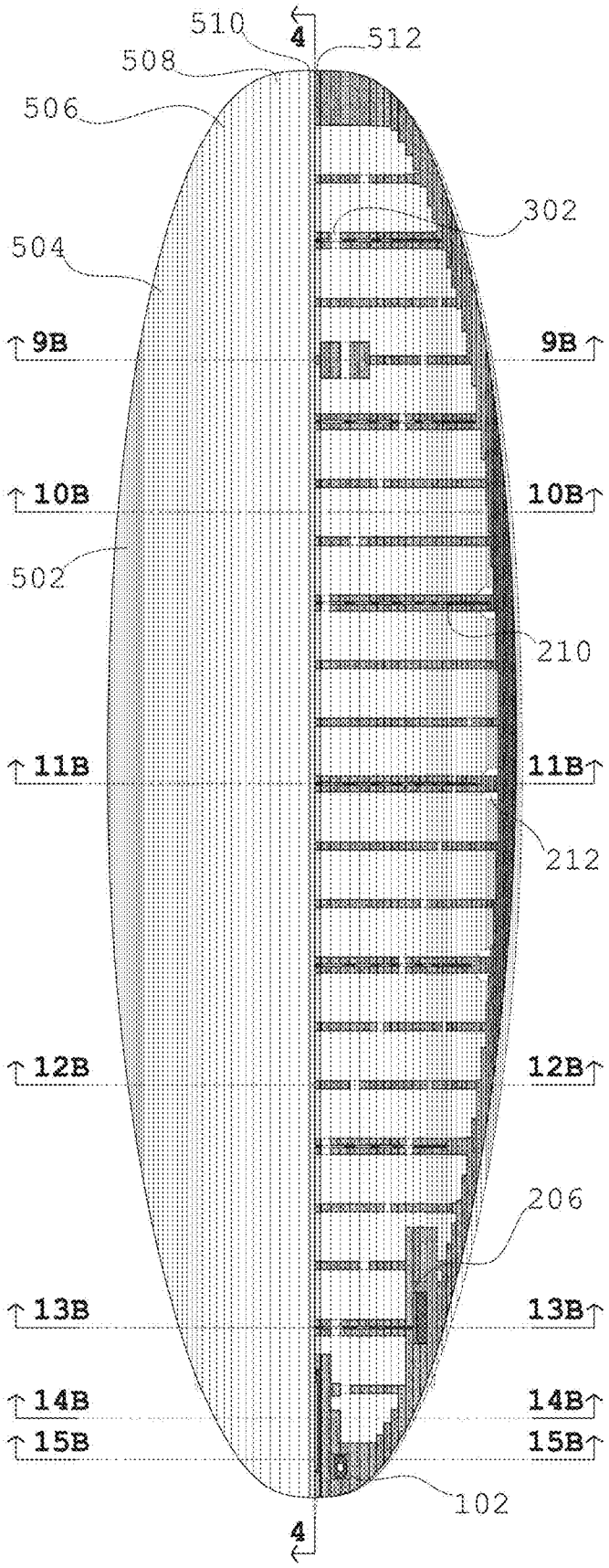
FIG. 5 shows a front view of an embodiment partially cut to show the interior hollow construction.
Figure 6:
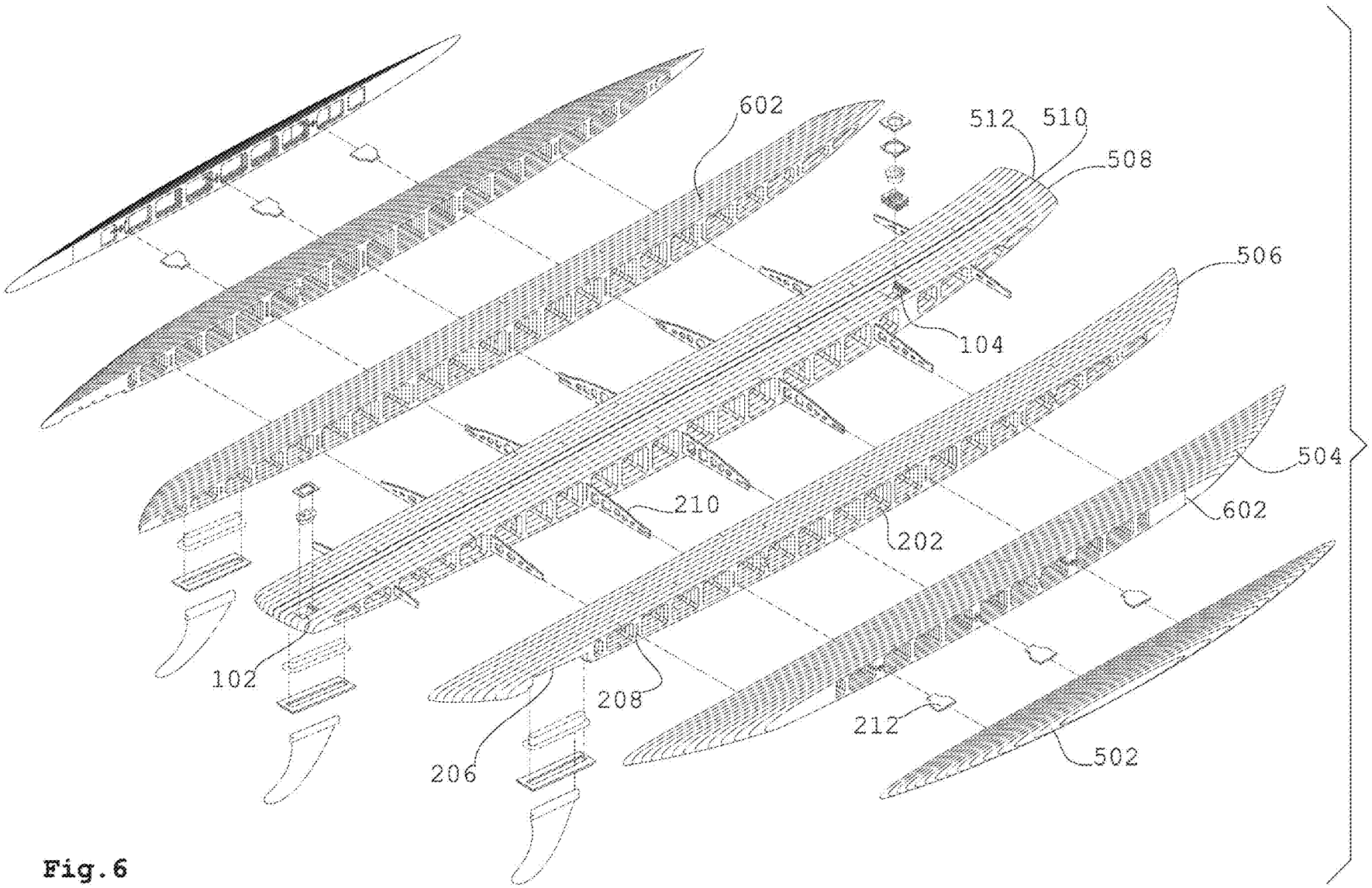
FIG. 6 shows an exploded view of the assembly of all the components of one embodiment.

FIGS. 3, 4 and 5 show an exploded view, a section and a front view of a hollow surfboard describing the chambers of the embodiment. All the air chambers (204) are connected via slots (302) in the longitudinal layers and perforations in the transverse ribs (210). The air chambers (204) ventilate to the outside through a vent plug (904). The heat of the sun causes the expansion of the air inside a chambered surfboard and needs to be equalized with the exterior to avoid potential breakage. The vent plug itself (904) is a device not part of the scope of this patent, but its installation is considered.

The longitudinal layers (502-512) in FIGS. 1-5 are pre-cut in a single piece from nose to tail of the surfboard for assembly. In the second embodiment (FIG. 6), the longitudinal layers can be split in smaller segments and bonded with butt joints (602) or half lap joints. The butt joints between the segments of a layer and the joints of the adjacent layers' segments are staggered to avoid continuity of the joints. As such, the structure of this embodiment is not compromised because of the staggered arrangement of joints. This second embodiment (FIG. 6) shows an exploded perspective view comprising all members of an exemplary surfboard that can be manufactured as a "Do it yourself" kit for the end user to assemble.

The embodiments shown in FIGS. 1-6 proposes the use of wood, a sustainable and recyclable material. The structural properties of wood avoid the need of applying an epoxy or polyester resin coating for additional strength. A coating of varnish or tung oil provides the watertight protection to the wooden plank. It is contemplated that the longitudinal layers forming the wooden plank of the embodiments in FIGS. 1-6 are made of balsa wood and their thicknesses are 3 mm (502), 6 mm (504), 9 mm (506) and 12 mm (508) starting from the sides to the symmetry axis. On the axis, the central spine is formed by one layer of 12 mm (512) and two layers of 1.5 mm (510) either sides of the central layer. Both layers of 1.5 mm (510) are made of hardwood to provide structural reinforcement. Transverse ribs (210) and flat dowels (212) are also made of hardwood for structural rigidity. Other thicknesses not described are also contemplated in other embodiments as well as different types of wood or composite materials. The properties of each type of wood to use, particularly stiffness and density will result in a specific water performance because of a different surfboard flexion and weight.

FIGS. 7A-18—Method of Construction of First Embodiment

This embodiment shows the construction of a very lightweight board made of balsa wood. The shape, type of surfboard and material is exemplary to illustrate this embodiment. This method in other embodiments includes different surfboard shapes and the use of other type of woods or materials.

Figure 7A:
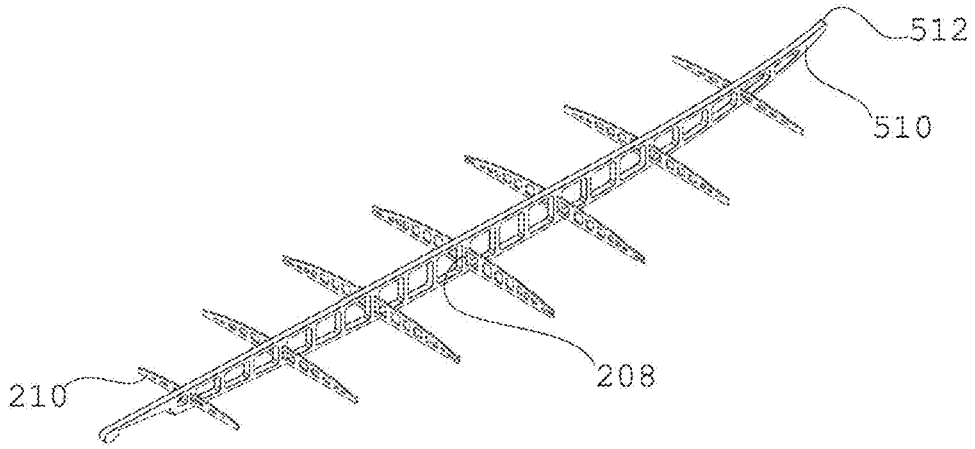
FIG. 7A shows the starting point of the construction sequence by bonding the longitudinal central stringer together with the transverse ribs.
Figure 7B:
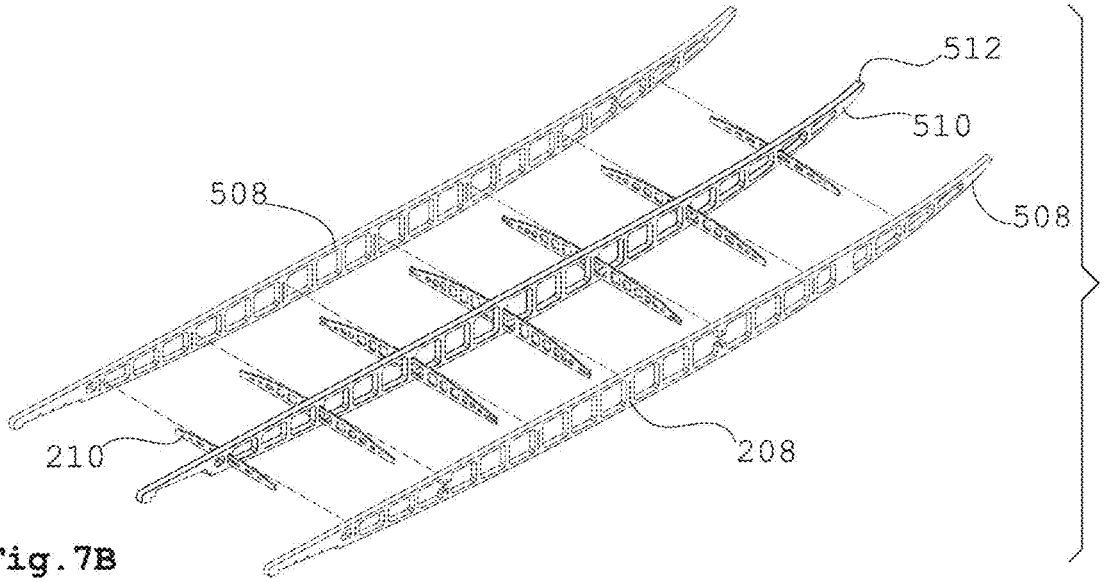
FIG. 7B shows the first two 12 mm layers to be assembled with the central stringer and transverse ribs.

The sequence of stacking and bonding the longitudinal layers (502-512) starts from the axis to the side rails. FIG. 7A shows the starting point of the construction of this embodiment. The central longitudinal layer (512) coincident with the axis of the surfboard is the first layer to be bonded with two adjacent layers of hardwood (510) to add strength to this embodiment. Other embodiments do not include these two layers of hardwood or they are differently intercalated. Afterwards, the ribs (210) are placed in position by sliding them into the slots (208) of the longitudinal layers (512, 510) until they are centred. The ribs are placed and glued perpendicular to the face of the longitudinal layers. The position of the following layers is guided by the transverse ribs (210).

Figure 7C:
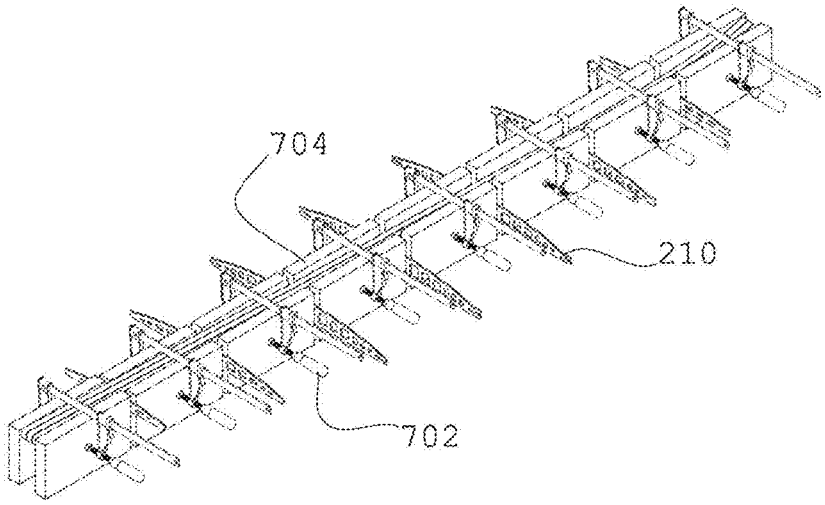
FIG. 7C shows the first two 12 mm layers, central stringer and transverse ribs clamped.

Once the central longitudinal layer (512), hardwood layers (510) and transverse ribs (210) are bonded together forming an skeleton, two adjacent layers (508), one on each side, slot into the ribs (FIG. 7B) until they are in contact with the layers of the skeleton. Adhesive is applied beforehand to the layers' faces and ribs' faces in contact. One or more layers are stacked in one go depending on the adhesive's curing time. For any number of layers stacked in one batch, pressure is applied while the adhesive is curing with clamps (702) or similar as shown in FIG. 7C. In order to distribute pressure evenly to the layers to be bonded, timber boards (704) are used between the layers and the clamps (702). It also avoids marking and damaging the longitudinal layers with the clamps (702). The timber boards' faces (704) in contact with the longitudinal layers have a plastic veneer to ensure they don't get bonded with the layers while the adhesive is curing and guarantee a safe removal.

Figure 7D:
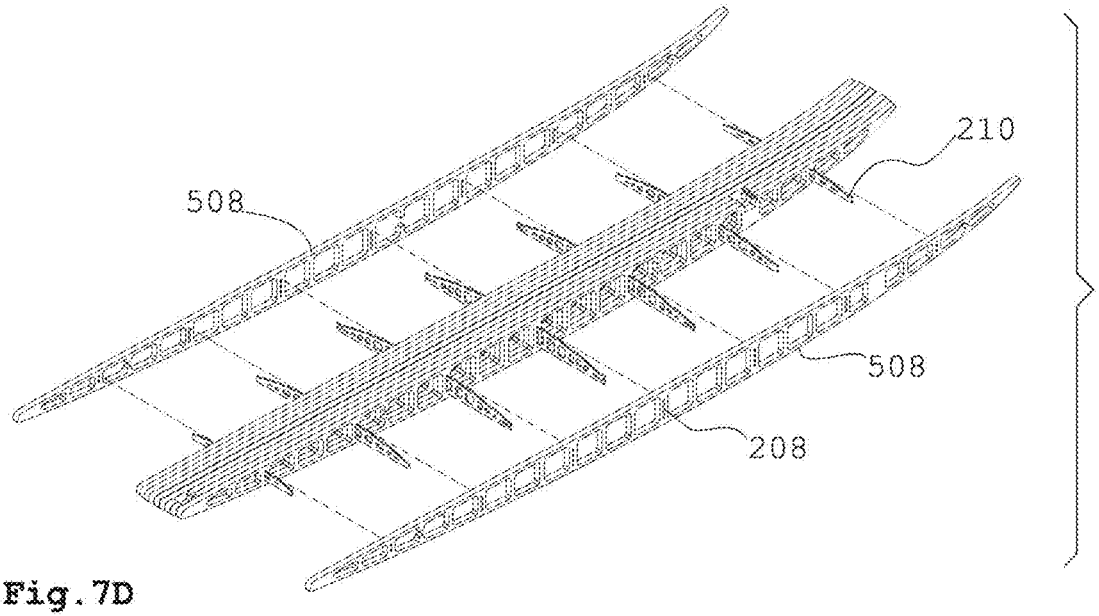
FIG. 7D shows two last two 12 mm layers to be assembled into the skeleton of an embodiment.
Figure 7E:
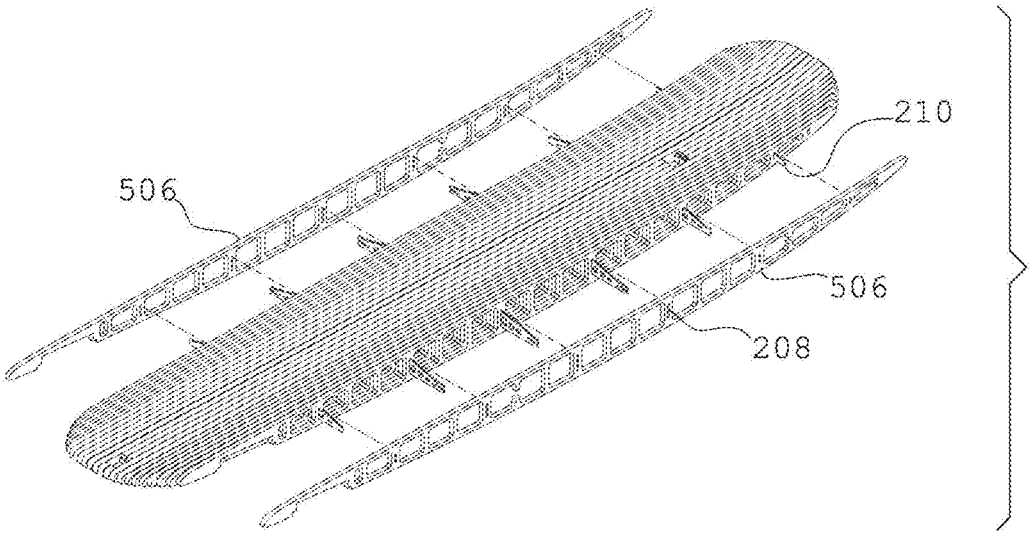
FIG. 7E shows the last two 9 mm layers to be assembled into the skeleton of an embodiment.
Figure 7F:
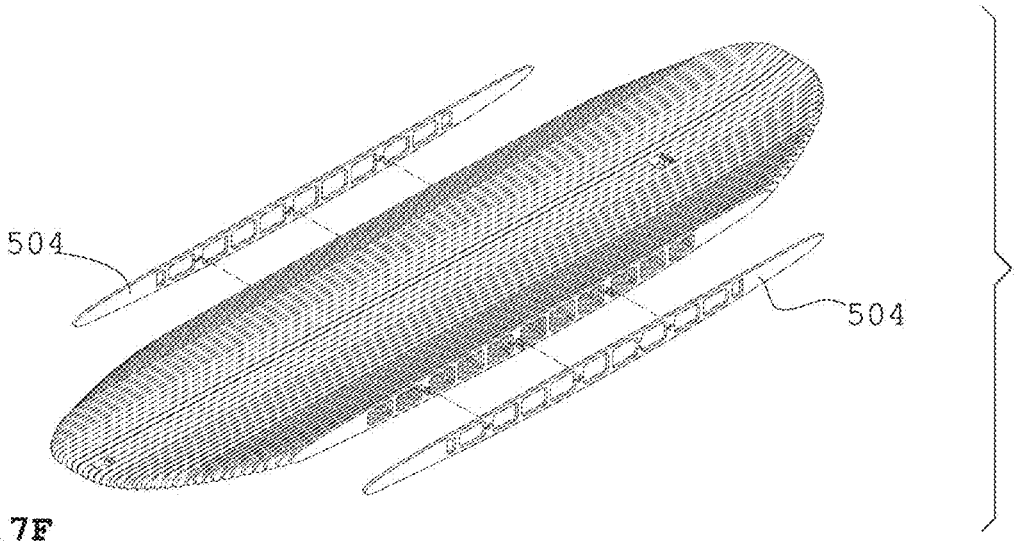
FIG. 7F shows the last two 6 mm layers to be assembled into the skeleton of an embodiment.

The assembly continues by stacking and bonding the adjacent longitudinal layers (508) at both sides of the skeleton, slotting them into the ribs (210) as shown in FIG. 7D. Adhesive is applied on the faces in contact and the layers are clamped until the adhesive is set. Pressure guarantees that there are no gaps between the layers and if any, they are filled with adhesive. This process is repeated for the following layers of predetermined thicknesses (506, 504) as shown in FIGS. 7E and 7F.

Figure 7G:
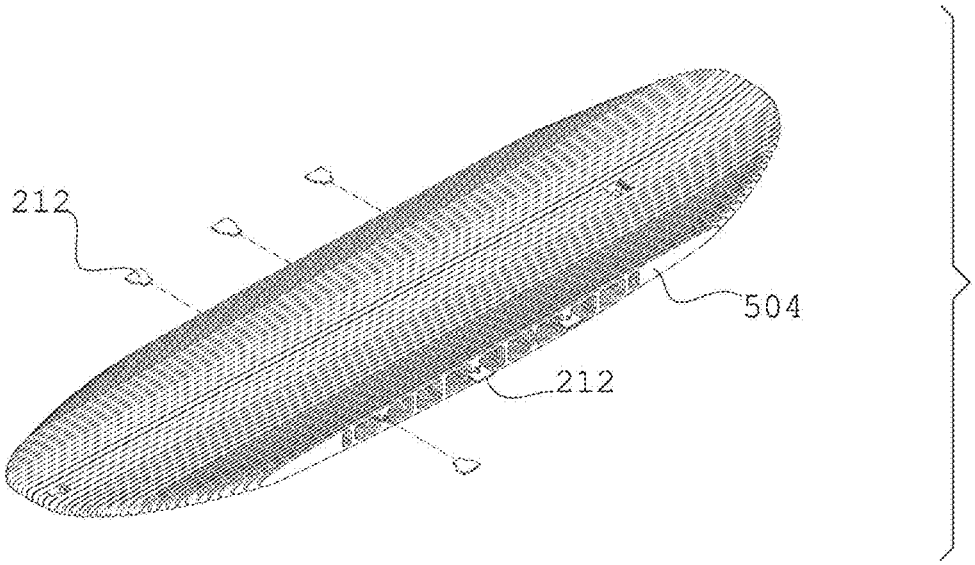
FIG. 7G shows the assembly of the flat dowels to the transverse ribs' ends with slotting joints.
Figure 7H:
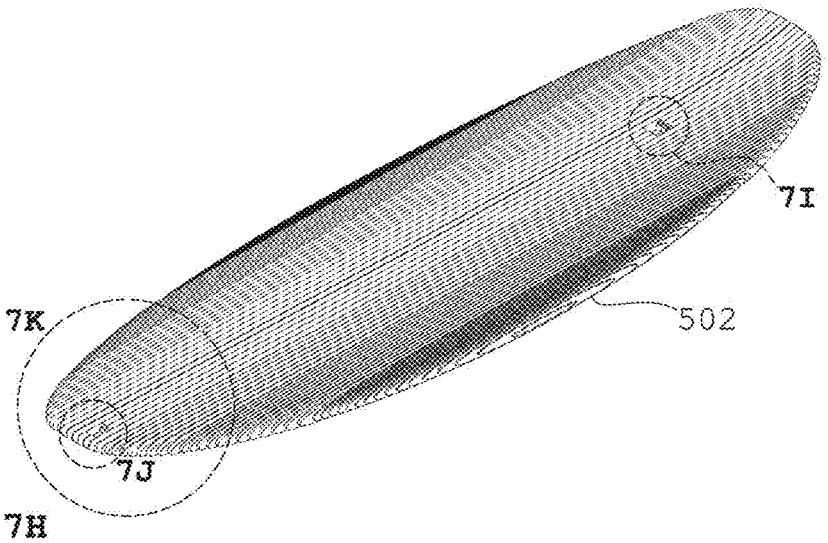
FIG. 7H shows all the longitudinal layers stacked and bonded in place including the layers forming the side rails.

FIG. 7G shows how the flat dowels (212) are slotted into the rib ends. The flat dowels will support the longitudinal layers (502) forming the side rails of the surfboard. Once the flat dowels (212) are bonded to the ribs (210), the thinnest layers of this embodiment (502) are stacked and bonded together and with the rest of the skeleton to form the plank (FIG. 7H). After all the longitudinal layers are stacked and bonded, the plank is completed (7H) and ready for fixing the plugs. The vent plug, leash plug and fin plugs are to be installed into the recesses in the longitudinal layers forming the plank.

Figure 7I:
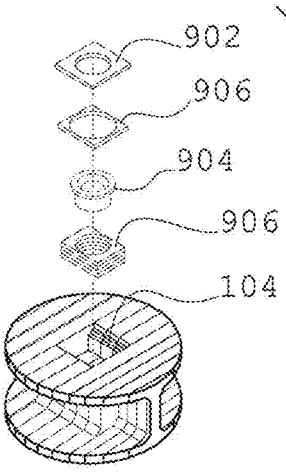
FIG. 7I shows the installation of an exemplary vent plug including spacers and a covering timber layer.

FIG. 7I shows the installation of an exemplary vent plug. An exterior recess (104) in the longitudinal layers is connected with the air chambers (204) allowing for pressure equalization of the air inside and the exterior through the vent plug (904). The heat of the sun causes the expansion of the air inside a chambered surfboard and needs to be equalized with the exterior to avoid potential breakage. Timber spacers (906) are first placed in the recess to help installing the vent plug (904) in position. Afterwards, the vent plug is inserted and fixed in place. These members are fixed with epoxy glue (132) to the plank. For a flush finish with the rest of the plank's surface, the vent plug (904) is covered with sheet of wood with a cut-out (902).

Figure 7J:
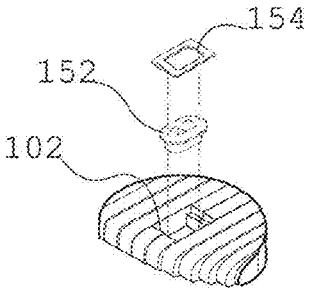
FIG. 7J shows the installation of an exemplary leash plug including a covering timber layer.

As shown in FIG. 7J, an exemplary leash plug (152) is inserted into a recess (102) at the tail of the plank, fixed with epoxy glue (132) and covered with a sheet of wood (154) on top. This cover is adapted to the shape of the leash plug and the recess contour.

Figure 7K:
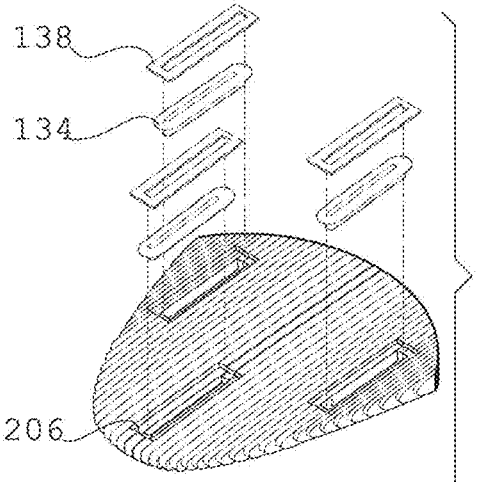
FIG. 7K shows the installation of exemplary fin plugs including a covering timber layer.

The installation of the fin plugs at the underside of the board follows a similar process. As shown in FIG. 7K, exemplary fin plugs (134) are inserted into the recesses (206) fixing them with epoxy glue (132) and covering each of them with a sheet of wood (138) with a cut-out following the contour. The recesses (206) provide enough space to give the desired vertical inclination and horizontal rotation to the fin plugs (widely known as "cant" and "toe"). The vent plug (904), leash plug (152), fin plugs (134) and fins (136) are exemplary devices not part of the scope of this patent.

Figure 7L:
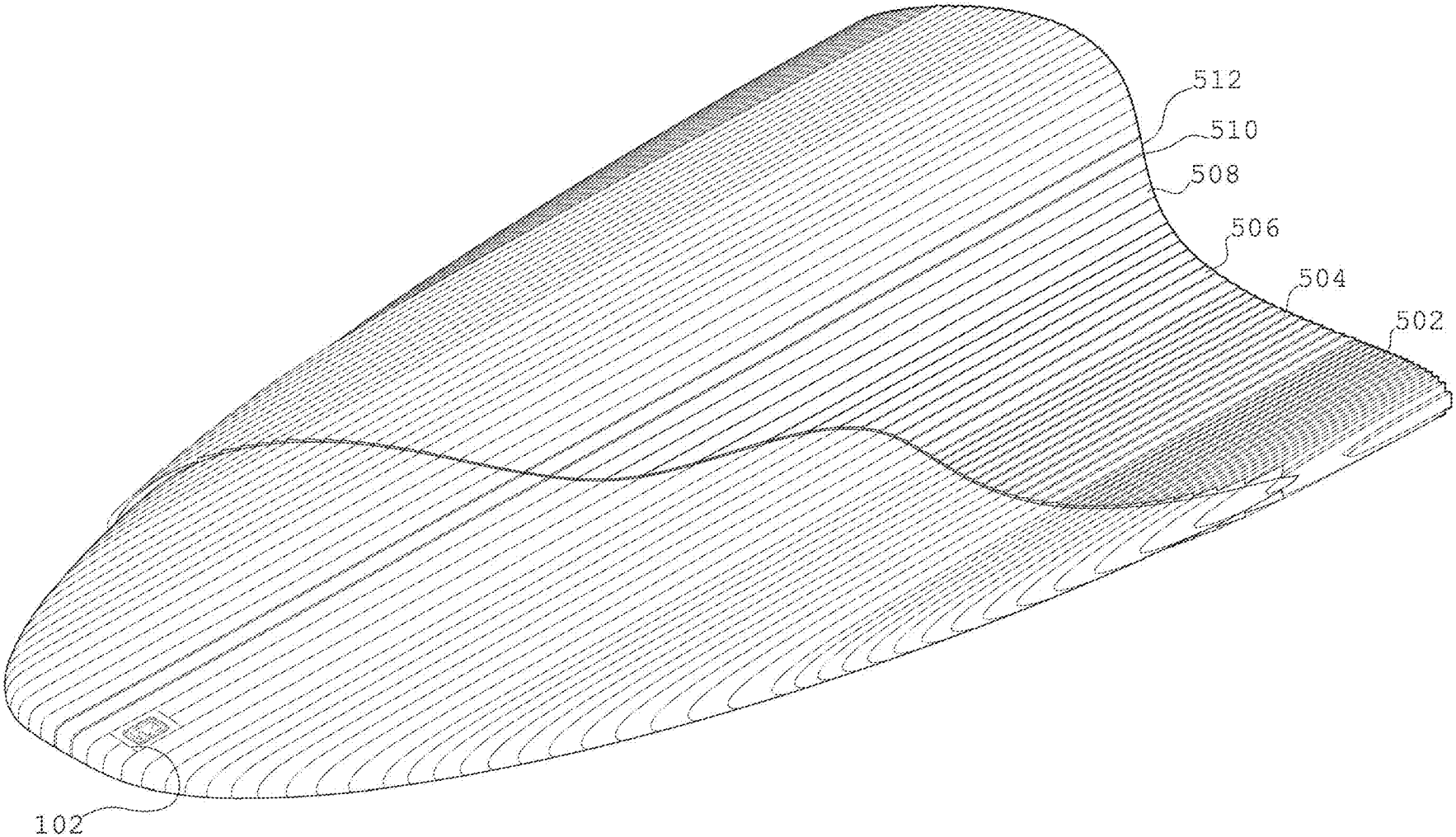
FIG. 7L shows the amount of material to be sanded from the longitudinal layers to achieve the geometry.

FIG. 7L illustrates the light sanding process to accomplish the surfboard's shape of this embodiment. It becomes evident the ease of adaptation of the layers of different thicknesses (502-512) to the double curvature shape of the surfboard. It can also be appreciated that the layers are getting thinner towards the sides where the curvature is becoming tighter. Once sanded, this embodiment has acquired the physical dimensions and properties of a surfboard. The use of wood of this embodiment requires watertight protection. The water tightness is achieved with a final coating of marine grade varnish or tung oil.

Figure 8A:
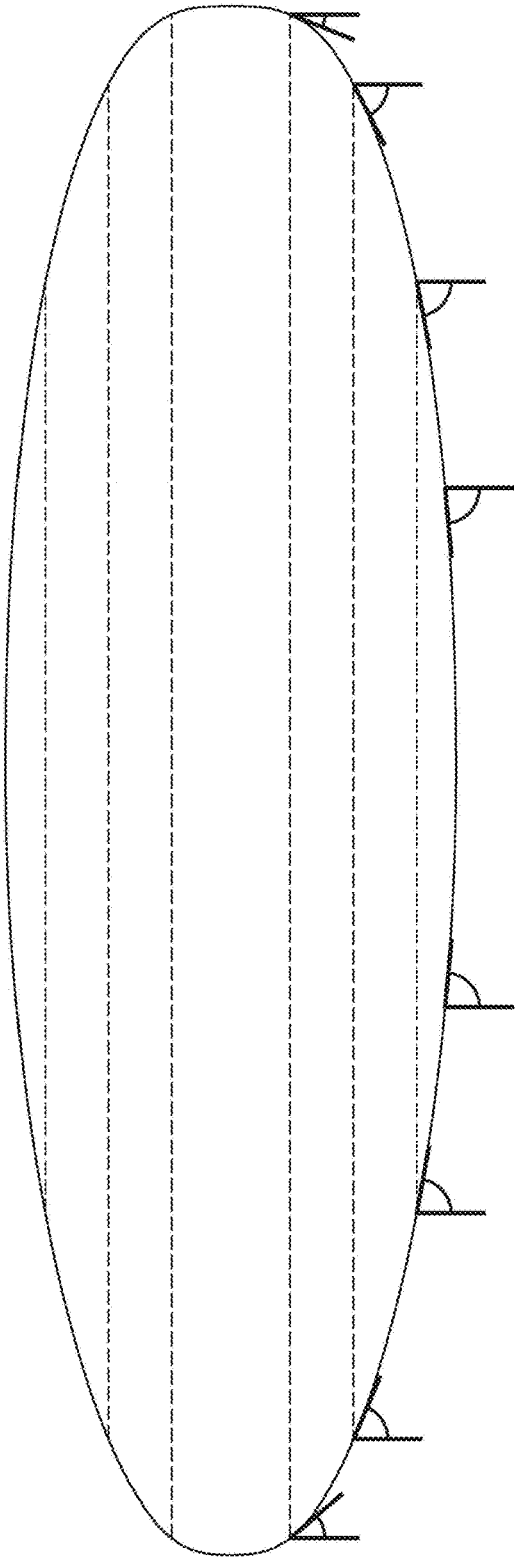
FIG. 8A shows the tangent angle of different outline points in an exemplary surfboard of an embodiment in frontal view.
Figure 8B:
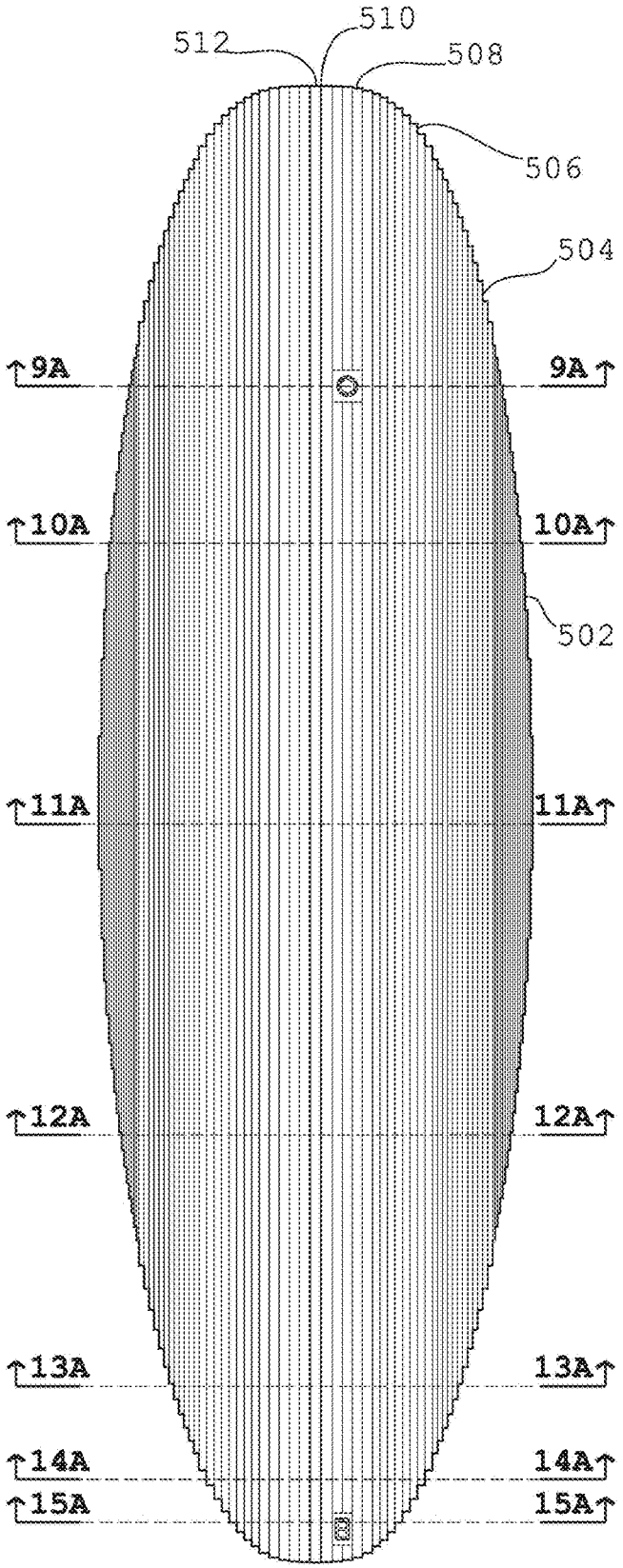
FIG. 8B shows the degree of adaptation of the plank to a surfboard outline with the array of layers of different thicknesses in frontal view.

The predetermined thicknesses of the longitudinal layers are dictated by the geometry of a surfboard's outline including nose, tail and rails. The diagram in plan of FIG. 8A shows tangent angles of different outline points in the exemplary surfboard of the first embodiment. The purpose of varying the thicknesses of the layers (502-512) is to adapt the plank (FIG. 8B) to the surfboard's outline (FIG. 8A). The plank before sanding shown in FIG. 8B, already has the geometrical features of the surfboard's shape to be constructed. The completed shell is obtained after a light sanding to smoothen the edges of the longitudinal layers (502-512) that form the plank as explained above. The ease of adaptation of the longitudinal layers of varying thicknesses to the contour of an exemplary surfboard become evident in FIGS. 8B to 18B.

Figure 9A:
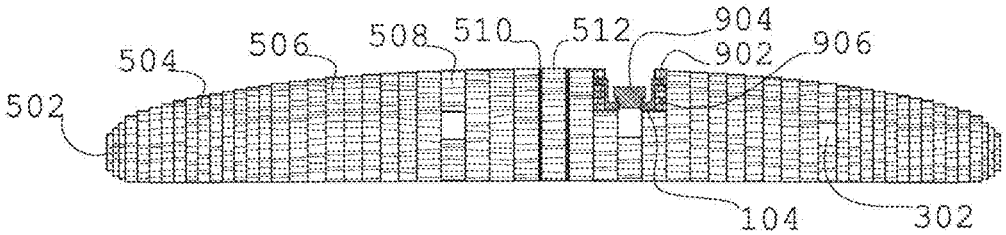
FIG. 9A shows a transverse section through the vent plug of an embodiment before sanding the plank.
Figure 9B:
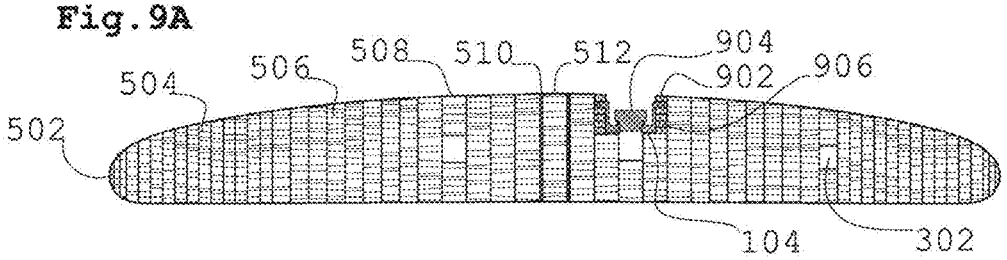
FIG. 9B shows a transverse section through the vent plug of an embodiment after sanding the plank.

FIG. 9A shows a transverse section through the plank of an embodiment before sanding. This section shows a multitude of longitudinal layers (502-512) stacked and bonded together. The vent plug (904) is installed in position with spacers (906) and covered with a timber layer (902). The difference can be appreciated with the same section after sanding the plank (FIG. 9B). FIGS. 9A and 9B show the slots (302) in the longitudinal layers to ventilate the air chambers (204) through the vent plug (904).

Figure 10A:
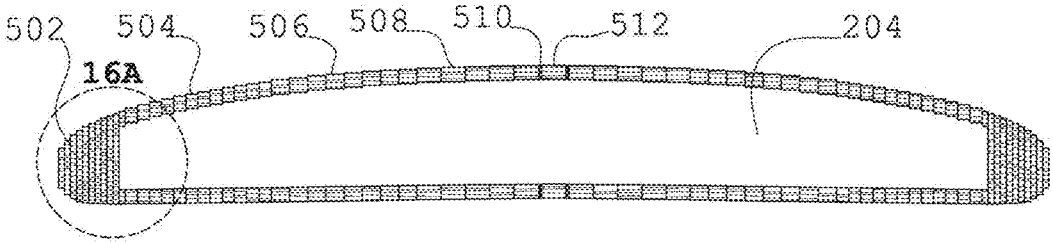
FIG. 10A shows a transverse section through a chamber of an embodiment before sanding the plank.
Figure 10B:
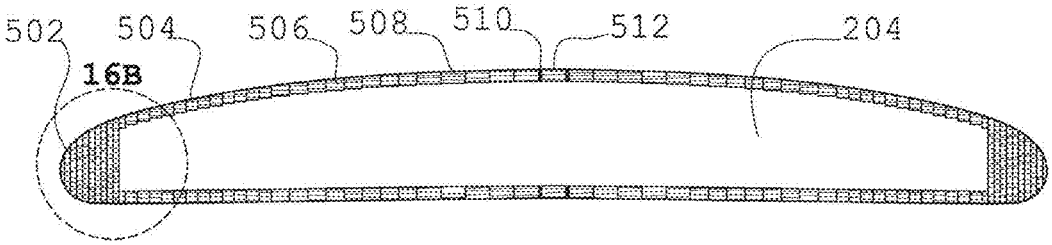
FIG. 10B shows a transverse section through a chamber of an embodiment after sanding the plank.

FIGS. 10A and 10B illustrates a transverse section through an air chamber (204) of an embodiment before sanding the plank (FIG. 10A) and after sanding it (FIG. 10B). It can be appreciated the variable thicknesses of the longitudinal layers (502-512) for the adaptation to the curvature of the surfboard; from the tightest curve on the side rails using thinner layers (502) to the centre of the surfboard that features a larger curve and therefore it uses thicker layers (508).

Figure 11A:
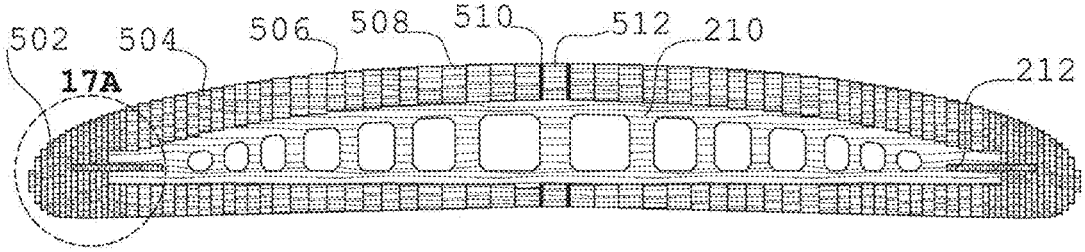
FIG. 11A shows a transverse section through a rib of an embodiment before sanding the plank.
Figure 11B:
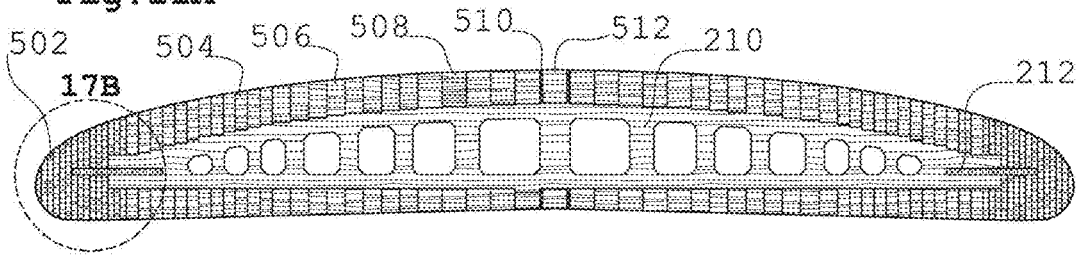
FIG. 11B shows a transverse section through a rib of an embodiment after sanding the plank.

FIGS. 11A and 11B show a section through a transverse rib (210) of an embodiment before sanding the plank (FIG. 11A) and after sanding it (FIG. 11B). The transverse ribs (210) are optimised with perforations to reduce weight without compromising the stiffness. The stepped outline on the top and the straight outline at the bottom is designed to allow for the correct insertion of the layers from the axis to the sides during construction. The flat dowels (212) are assembled with slotting joints at both ends of several ribs (210). They support the layers forming the side rails and connect them to the transverse ribs.

Figure 12A:
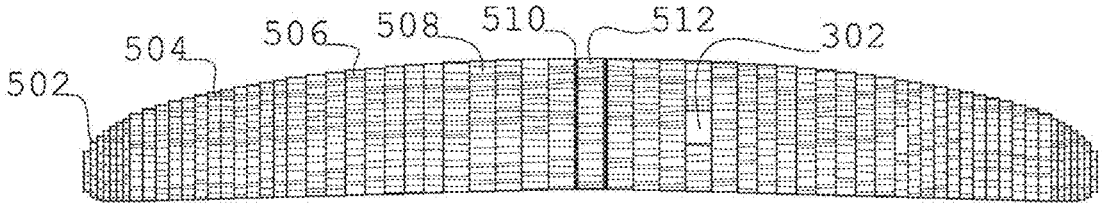
FIG. 12A shows a transverse section through a solid "midrib" of an embodiment before sanding the plank.
Figure 12B:
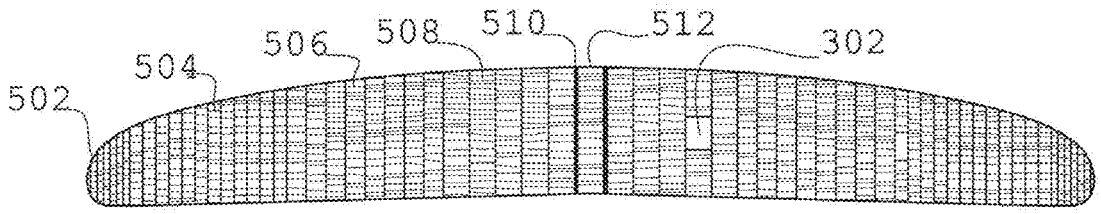
FIG. 12B shows a transverse section through a solid "midrib" of an embodiment after sanding the plank.

A transverse section through a solid "midrib" of an embodiment is shown in FIG. 12A before sanding the plank and after sanding it in FIG. 12B. The solid midribs of the longitudinal layers (502-512) split the hollow interior of a surfboard into several air chambers connected with slots (302) for ventilating throughout.

Figure 13A:
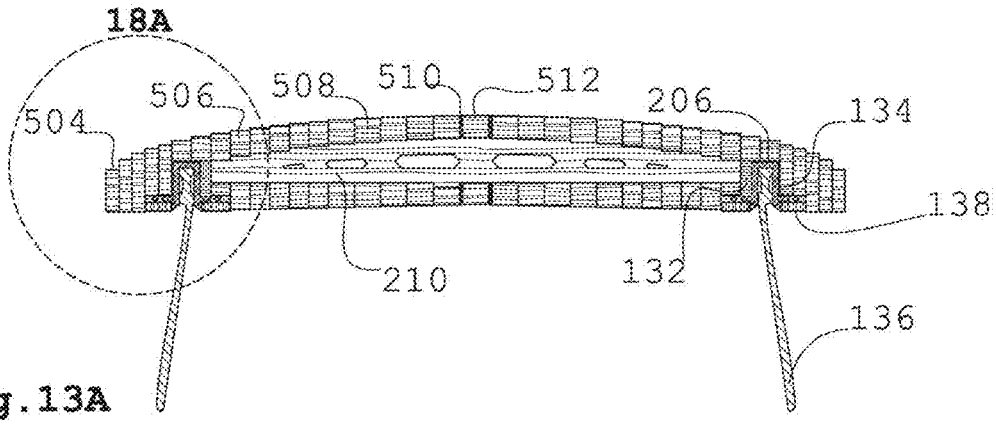
FIG. 13A shows a transverse section through the side fins of a "thruster setup" of an embodiment before sanding the plank.
Figure 13B:
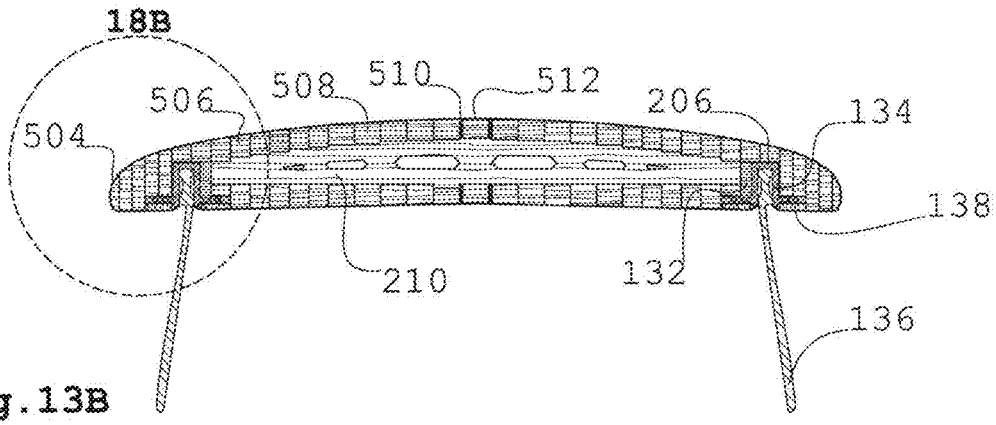
FIG. 13B shows a transverse section through the side fins of a "thruster setup" of an embodiment after sanding the plank.

FIG. 13A and FIG. 13B show a transverse section through the side fins of a "thruster setup" of an embodiment before sanding the plank (FIG. 13A) and after sanding it (FIG. 13B). This section shows how the exemplary fin plugs (134) are concealed into the plank and bonded with epoxy glue (132) to the recesses in the longitudinal layers (506, 504). Sheets of wood (138) flush with the exterior surface cover the fin plugs (134). These wooden covers (138) fit in the recesses (206) and have cut-outs for the installation of the fins (136) into the fin plugs (134).

Figure 14A:
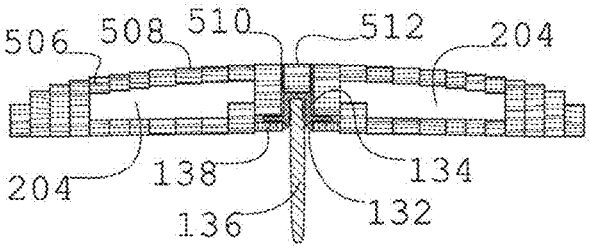
FIG. 14A shows a transverse section through the middle fin of a "thruster setup" of an embodiment before sanding the plank.
Figure 14B:
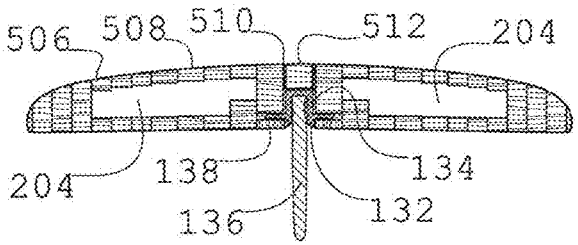
FIG. 14B shows a transverse section through the middle fin of a "thruster setup" of an embodiment after sanding the plank.
Figure 15A:
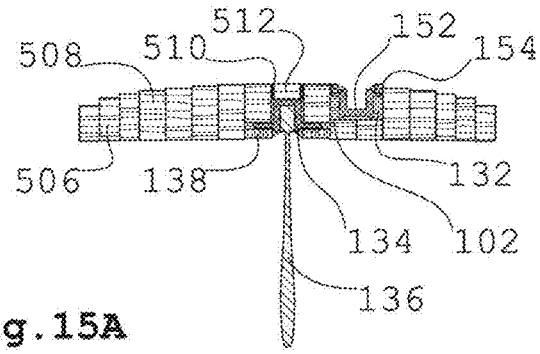
FIG. 15A shows a transverse section through the middle fin and leash plug of an embodiment before sanding the plank.
Figure 15B:
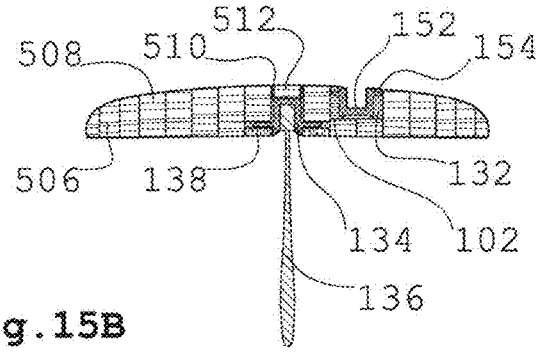
FIG. 15B shows a transverse section through the middle fin and leash plug of an embodiment after sanding the plank.

A transverse section through the middle fin of a "thruster setup" of an embodiment is shown in FIG. 14A before sanding the plank and in FIG. 14B after sanding it. A recess (206) in the central longitudinal layer (512) and adjacent longitudinal layers (510, 508) allow for the installation of the middle fin plug (134). It follows the same installation process as the side fin plugs. FIGS. 15A and 15B show a different section through the middle fin plug (134) and the leash plug (152) before sanding (FIG. 15A) the plank and after sanding it (FIG. 15B). The location of the leash plug (152) avoid clashing with the middle fin plug (134).

Figure 16A:
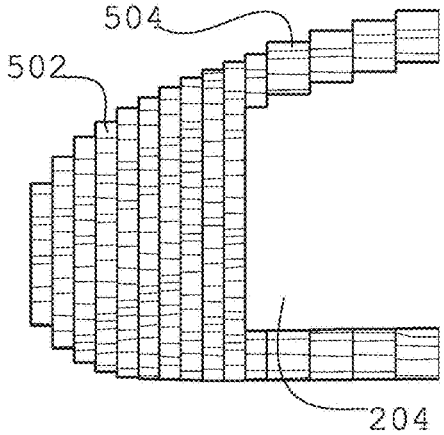
FIG. 16A shows a partial section of the side rail before sanding the plank, cut through a chamber.
Figure 16B:
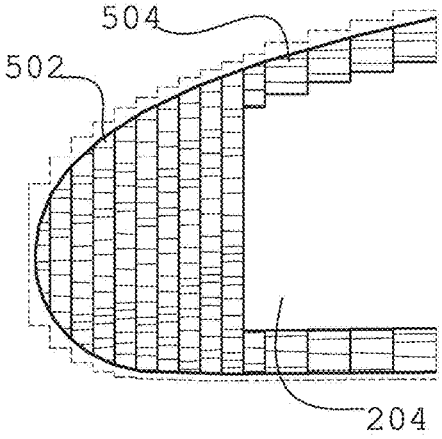
FIG. 16B shows a partial section of the side rail after sanding the plank, cut through a chamber.
Figure 17A:
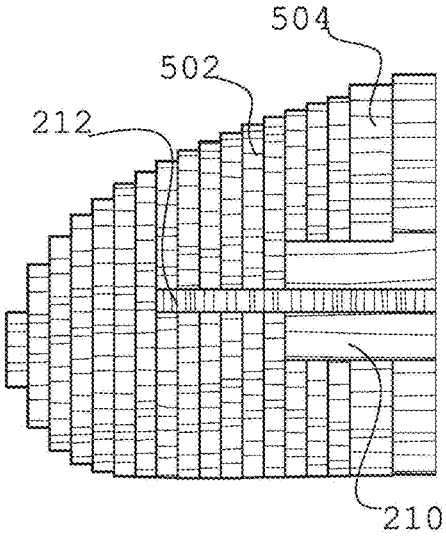
FIG. 17A shows a partial section of the side rail before sanding the plank, cut through a flat dowel and transverse rib.
Figure 17B:
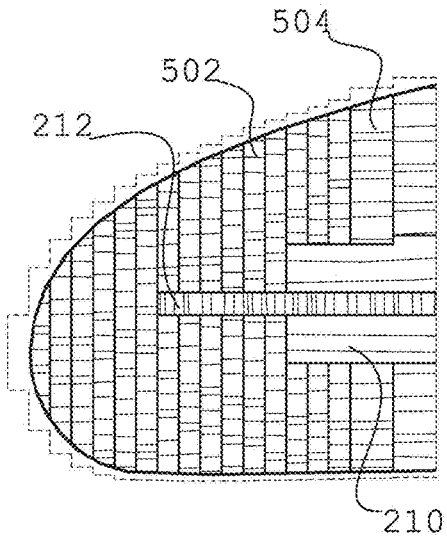
FIG. 17B shows a partial section of the side rail after sanding the plank, cut through a flat dowel and transverse rib.
Figure 18A:
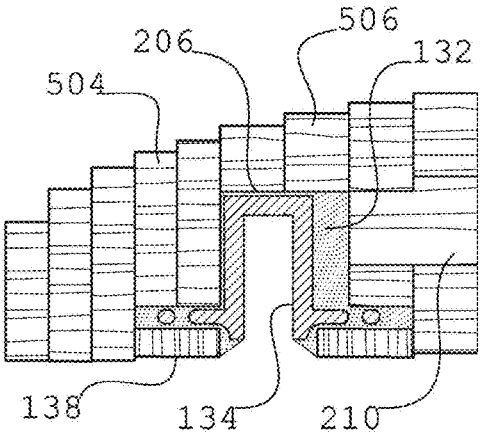
FIG. 18A shows a partial section of the side rail before sanding the plank, cut through a fin plug and transverse rib.
Figure 18B:
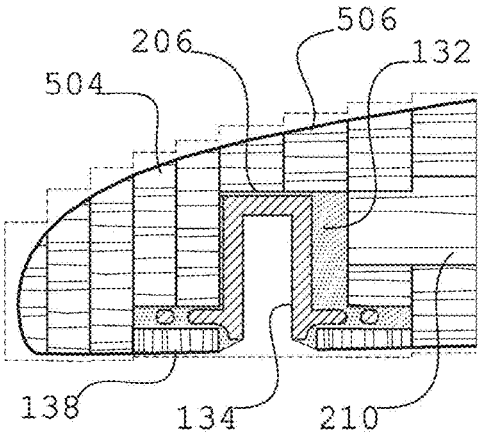
FIG. 18B shows a partial section of the side rail after sanding the plank, cut through a fin plug and transverse rib.

FIGS. 16A to 18B show partial sections through different points of the side rails. FIG. 16A shows a side rail section through an air chamber (204) of an embodiment before sanding the plank and FIG. 16B shows the same section after sanding it. It can be noted the amount of material to be removed with the sanding process and the adaptation of the layers (502, 504) to the rail outline. FIGS. 17A and 17B show a partial section through a flat dowel (212) of an embodiment before sanding the plank (FIG. 17A) and after sanding it (FIG. 17B). The flat dowel (212) is assembled with a slotting joint to the transverse rib (210) for connecting the side rail of the surfboard to the rib. FIGS. 18A and 18B show a partial section through a fin plug (134) of an embodiment before and after sanding the plank respectively. The recess (206) in the longitudinal layers is wider than the fin plug (134) to place it slightly rotated, pointing towards the stringer (aka "fin toe"). The recess is filled with epoxy glue (132) and the fin plug (134) is installed and covered with a sheet of wood with a cut-out (138) concealing the fin plug.

Figure 19:
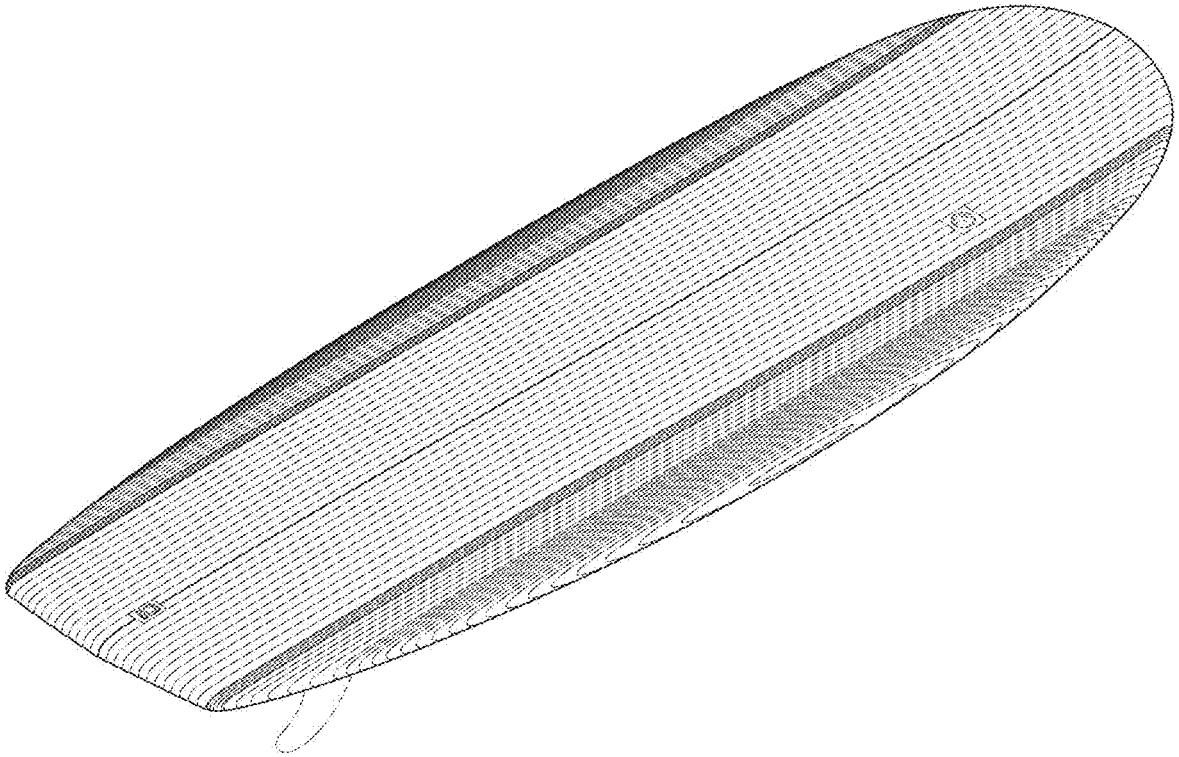
FIG. 19 shows an embodiment with a different layer arrangement as a response to the board's outline and a different vent plug and leash plug position.

FIG. 19—Additional Embodiments

Softwoods like balsa wood provides a lightweight surfboard. The combination or sole use of other softwoods such us paulownia and red cedar or hardwoods like oak, wiliwili and koa are also possible. This includes manufactured or engineered wood, composite wood and laminated timber seeking for strength, other stiffness to weight ratios or more impact resistance. The materials of the additional embodiments are not limited to the ones mentioned above.

The method of construction explained in the first embodiment applies to any type of shape and surfboard category: shortboard, fish, gun, malibu, evolutive, longboard, etc. The ease of adaptability to any shape by varying the thicknesses of the layers is one of the features of several embodiments. The quantity of layers of each predetermined thickness depends on the geometry of the surfboard shape to be accomplished, as described for the first embodiment in FIGS. 8A and 8B. An additional embodiment is shown in FIG. 19. It comprises a different layers' arrangement as a result of the board's outline and a different vent plug and leash plug position compared to the first embodiment.

The method of surfboard construction explained in the first embodiment will apply to other watercrafts such us bodyboards or belly boards, hand planes, stand-up paddle boards, paddleboards, and kayaks including other types of hollow canoes.

An additional embodiment contemplates the longitudinal layers with an angled contour instead of being cut perpendicular to the face of the layers. This variation allows the layers to follow the final surfboard's shape more and further reduces the excess of material to be sanded.

Figure 20:
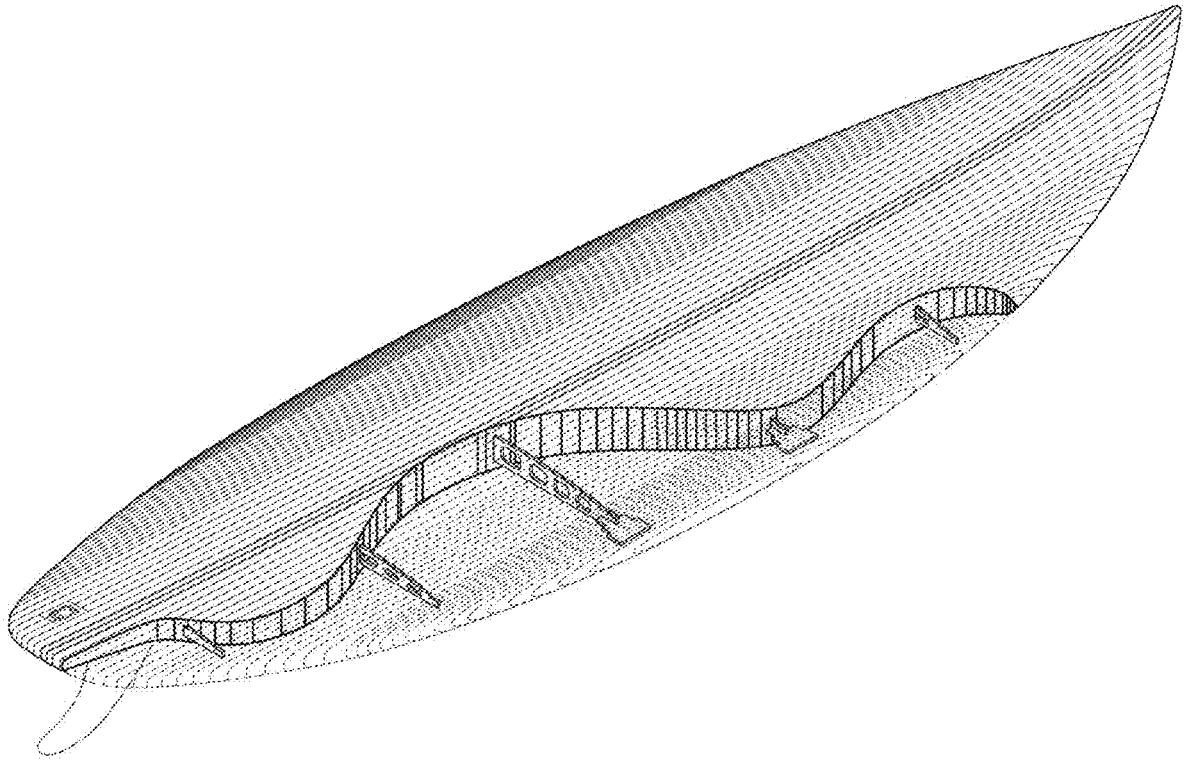
FIG. 20 shows an alternative embodiment of a solid wooden surfboard without air chambers.

FIG. 20—Alternative Embodiments

The first embodiment describes a chambered surfboard and thus a very lightweight board as over half of it is hollow (FIG. 1-5). An alternative embodiment comprises longitudinal layers without perforations obtaining a solid board and avoiding the need of a vent plug for pressure equalization as in chambered boards. A solid surfboard construction is used for ancient Hawaiian style surfboards such us "Olos" and "Alaias" or very thin performance shortboards (FIG. 20). The alternative embodiment shown in FIG. 20 correspond to a shortboard with a bespoke layer arrangement of predetermined thicknesses as a response to its specific geometry.

Advantages

Several advantages of the embodiments of my surfboard become evident:

(a) The dimensions of the longitudinal layers split in segments of the second embodiment, provides a more compact and easy packaging when manufactured as construction kits. The staggered arrangement of joints guarantees the structural integrity.

(b) The laminated assembly of the layers is effectively a composite frame that enhance the structural properties of wood.

(c) The ease of adaptability to a desired surfboard geometry by varying the thicknesses of the longitudinal layers, replaces the known manual carving and shaping process with a light sanding. This method also avoids unwanted deviations from the planned geometry and reduces the time expended on sanding, either by hand or machine.

(d) The use of layers of predetermined thickness results in more volume carved internally for a chambered surfboard, hence reducing weight for a better water performance.

(e) The ease of construction allows for a layperson to assemble a board having the pre-cut wooden layers. No advanced skills are required to obtain the final shape with the sanding process.

(f) The ease of construction, manufacture and packaging make this method adequate for "Do It Yourself" construction kits.

(g) The use of sustainable and recyclable materials avoiding the emanation of toxic particles during the sanding process.

(h) High degree of adaptability to any surfboard geometry.

(i) Carbon footprint reduction during the construction process compared to relevant prior art.

CONCLUSION, RAMIFICATIONS, AND SCOPE

Thus, the reader will see that at least one embodiment of my surfboard provides an easy construction method for a sustainable and lightweight surfboard that can be built by laypersons regardless of their woodworking experience and/or capabilities.

While my above description contains many specificities, these should not be construed as limitations on the scope, but rather as an exemplification of one or several embodiments thereof. Many other variations are also possible. For example, all the longitudinal layers can have the same thickness seeking for construction simplicity. Separately, it is contemplated a final coat of epoxy resin to achieve an additional strength and the water tightness of the surfboard in lieu of varnish or tung oil.

Accordingly, the scope should be determined not by the embodiments illustrated, but by the appended claims and their legal equivalents.

What is claimed is:

1. A surfboard comprising:

a. a multitude of longitudinal layers of wood of the length of a desired surfboard, of the width of the surfboard's thickness and vertical oriented, arranged perpendicular to both faces of said desired surfboard along its length, trimming each of said longitudinal layers following specific longitudinal contour sections of said desired surfboard, said longitudinal layers having predetermined thicknesses varying from the axis of the surfboard to the side rails so that said thicknesses are adapted to the transversal profile of said desired surfboard, said longitudinal layers having predetermined slots along their length, b. a plurality of transverse ribs in perpendicular direction to said longitudinal layers and perpendicularly arranged to both faces of said desired surfboard, said transverse ribs being predeterminedly spaced along the length of said longitudinal layers, said transverse ribs being no longer than the surfboard's width so that they are embedded in said longitudinal layers once assembled, said transverse ribs on the order of 3 mm thick, having a contour that allows for said longitudinal layers to be slotted into said transverse ribs starting from the axis to the side rails so that said transverse ribs guide the position of said longitudinal layers during the assembly and join said longitudinal layers together.

2. A method of constructing a surfboard comprising:

a. providing a multitude of longitudinal layers of wood of the length of a desired surfboard, of the width of the desired surfboard's thickness and vertical oriented, arranged perpendicular to both faces of said desired surfboard along its length, trimming each of said longitudinal layers following specific longitudinal contour sections of said desired surfboard, said longitudinal layers having predetermined thicknesses varying from the axis of the surfboard to the side rails so that said thicknesses are adapted to the transversal profile of said desired surfboard, said longitudinal layers having predetermined slots along their length, b. providing a plurality of transverse ribs in perpendicular direction to said longitudinal layers and perpendicularly arranged to both faces of said desired surfboard, said transverse ribs being predeterminedly spaced along the length of said longitudinal layers, said transverse ribs being no longer than the surfboard's width so that they are embedded in said longitudinal layers once assembled, said transverse ribs on the order of 3 mm thick, having a contour that allows for said longitudinal layers to be slotted into said transverse ribs starting from the axis to the side rails, c. stacking and bonding said longitudinal layers together starting from the axis to the side rails by slotting said longitudinal layers into said transverse ribs so that said transverse ribs guide the position of said longitudinal layers during the assembly, generating the shape of said desired surfboard, d. sanding said longitudinal layers once bonded so that the surface has a smooth finish and applying a waterproofing coating to said surface, whereby said longitudinal layers of predetermined thicknesses bonded and sanded form the geometry of said desired surfboard with a high degree of precision and adaptability, reducing assembly time, sanding time and waste during construction.

* * * * *